United States Patent [19]

Jacobs et al.

[11] Patent Number: 4,699,671

[45] Date of Patent: Oct. 13, 1987

[54] TREATMENT FOR OVERCOMING IRRADIATION INDUCED STRESS CORROSION CRACKING IN AUSTENITIC ALLOYS SUCH AS STAINLESS STEEL

[75] Inventors: Alvin J. Jacobs, San Jose; Gerald M. Gordon, Soquel, both of Calif.

[73] Assignee: General Electric Company, San Jose, Calif.

[21] Appl. No.: 745,061

[22] Filed: Jun. 17, 1985

[51] Int. Cl.[4] ..... C22F 1/10; C21D 6/00

[52] U.S. Cl. ..... 148/13; 148/136

[58] Field of Search ..... 148/136, 13, 3

[56] References Cited

U.S. PATENT DOCUMENTS

| | | | |
|---|---|---|---|
| 2,172,428 | 9/1939 | Wulff et al. | 148/4 |
| 2,527,287 | 10/1950 | Ziegler et al. | 148/12.3 |
| 2,553,330 | 5/1951 | Post et al. | 75/122 |
| 2,553,707 | 5/1951 | Goller | 148/31 |
| 3,253,966 | 5/1966 | Malagari et al. | 148/38 |
| 3,340,048 | 9/1967 | Floreco | 75/128 |
| 3,563,813 | 2/1971 | Webster | 148/12.4 |
| 3,650,845 | 3/1972 | Oda et al. | 148/2 |
| 3,756,865 | 9/1973 | Sastri | 148/12 |
| 3,839,100 | 10/1974 | Ota | 148/37 |
| 4,022,640 | 5/1977 | Tanczya | 148/37 |
| 4,042,421 | 8/1977 | Sype et al. | 148/12 |
| 4,224,062 | 9/1980 | Darnfors | 75/128 |
| 4,227,923 | 10/1980 | Watanabe et al. | 75/128 |

*Primary Examiner*—R. Dean

*Attorney, Agent, or Firm*—Robert R. Schroeder; Raymond G. Simkins

[57] ABSTRACT

Stress corrosion cracking of austenitic stainless steel or nickel-based alloys attributable at least in part to exposure to irradiation is reduced with a specific heat treatment.

20 Claims, No Drawings

TREATMENT FOR OVERCOMING IRRADIATION INDUCED STRESS CORROSION CRACKING IN AUSTENITIC ALLOYS SUCH AS STAINLESS STEEL

BACKGROUND OF THE INVENTION

Stainless steel alloys, especially those of the high chromium-nickel types, are commonly used for components employed in nuclear reactors due to their well known resistance to corrosive and other aggressive conditions. For instance, nuclear fuel, neutron absorbing control units and neutron source holders are frequently clad or contained within a sheath or housing of stainless steel of Type 304 or similar alloy compositions. Many such components, including those mentioned, are located in and about the fuel core of the nuclear reactor where the aggressive conditions such as radiation and temperature are the most rigorous and debilitating.

Solution or mill annealed stainless steels are generally considered to be essentially immune to intergranular stress corrosion cracking, among other means of deterioration. However, stainless steels have been found to occasionally degrade and fail due to intergranular stress corrosion cracking following exposure to high irradiation such as is typically encountered in service within and about the fuel core of water cooled nuclear fission reactors. Such irradiation related intergranular stress corrosion cracking failures have occurred notwithstanding the stainless steel metal being in the so-called solution or mill annealed condition, namely having been treated by heating up to within a range of typically about 1,850° to 2,050° F., then rapidly cooled as a means of solutionizing carbides and inhibiting their nucleation and precipitation out into grain boundaries.

Accordingly, it is theorized that high levels of irradiation resulting from a concentrated field or extensive exposure, or both, are a significantly contributing cause of such degradation of stainless steel, possibly due to induced hardening and/or by promoting segregation of impurities therein. One theory suggested is that irradiation damages the crystalline structure of stainless steel causing vacancies therein which facilitate the rate of diffusion of impurities or trace elements such as phosphorus and silicon and their migration to grain boundaries.

Austenitic nickel-based alloys, moreover, appear to exhibit the same sensitivity to irradiation and in turn susceptibility to intergranular stress corrosion cracking as austenitic stainless steels.

SUMMARY OF THE INVENTION

This invention comprises a means of treating stainless steel and nickel-based alloys of the austenitic type, including articles manufactured therefrom, that have been exposed to irradiation which provides resistance to the occurrence of intergranular stress corrosion cracking therein. The treatment for irradiated stainless steel, etc. comprises maintaining a stainless steel or nickel-based alloy articles at a moderate temperature for a relatively brief period as set forth hereinafter.

OBJECTS OF THE INVENTION

It is a primary object of this invention to provide a means of inhibiting the occurrence of intergranular stress corrosion cracking in austenitic alloys such as stainless steel and nickel-based alloys, and articles of manufacture thereof, which have been exposed to irradiation.

It is also an object of this invention to provide an effective and feasible treatment for imparting resistance to intergranular stress corrosion cracking in irradiated stainless steel of the chromium-nickel types and nickel-based alloys, and products produced therefrom.

It is a further object of this invention to provide an economical and practical method for inhibiting the failure of stainless steel components for nuclear reactors and other manufactured articles of stainless steel or nickel-based alloys encountering irradiation due to intergranular stress corrosion cracking.

It is an additional object of this invention to provide an effective method for dealing with the problem of intergranular stress corrosion cracking in irradiated stainless steel and nickel-based alloys that does not entail any adverse effects upon the treated alloy.

DETAILED DESCRIPTION OF THE INVENTION

This invention is primarily concerned with articles, or components thereof, manufactured from austenitic alloys comprising stainless steel and nickel-based alloys which have served in the radioactive environment of a nuclear reactor or other radiation related devices or environments. Moreover, the invention is especially effective in dealing with stainless steel reactor components which have been subjected to long term irradiation whereby they are likely to have succumbed to the debilitating effects of significant levels of irradiation. The invention thus comprises a remedial measure for overcoming radiation induced degradation in used and exposed elements, as well as a preventative.

This invention is particularly directed to a potential deficiency of susceptibility to irradiation degradation sometimes encountered with chromium-nickel austenitic stainless steel alloys, comprising Type 304 and related high chromium-nickel alloys such as listed in Table 5-4 on pages 5-12 and 5-13 of the 1958 edition of the *Engineering Materials Handbook,* edited by C. L. Mantell. These alloys comprise austenitic stainless steels of about 16 to about 20 weight percent of chromium and about 6 to about 15 weight percent of nickel with up to a maximum of about 2 percent weight of manganese, and the balance iron with only incidental impurities. Type 304 comprises about 18 to about 20 percent weight of chromium and about 8 to about 12 percent weight of nickel as defined in the above Handbook.

This invention is also directed to nickel-based alloys such as those marketed under the "INCONEL" trademark of the International Nickel Co. Such nickel-based alloys comprise a major portion of nickel with minor portions of chromium, iron and incidental impurities, and examples are given on pages 10-4 and 10-5 of *The Engineering Material Handbook,* (supra).

This susceptibility to irradiation degradation of chromium-nickel austenitic stainless steel and nickel-based alloys is sometimes manifested in the occurrence of intergranular stress corrosion cracking of the alloy, especially in locations of high stress. This in turn can result in the failure of the structural integrity of the metal or part of a component formed therefrom. Failure of components within a nuclear reactor can frequently result in very costly reactor down time, as well as complex and expensive repairs or replacement.

This invention, as will become apparent, comprises a relatively low cost and easy to apply treatment of austenitic stainless steel and nickel-based alloys and/or manufactured articles thereof which overcomes or imparts resistance to the occurrence of intergranular stress corrosion cracking of such stainless steel alloys or articles which are subjected to irradiation.

Specifically, the method of this invention for dealing with intergranular stress corrosion cracking in irradiated austenitic chromium-nickel stainless steel and nickel-based alloys or articles thereof, and impeding its occurrence, comprises simply heating the irradiated alloy to a moderate temperature and holding it at such a temperature over a prescribed relatively brief period of time. The preferred temperature for this heat treatment comprises the approximate range of about 400° to about 500° C. (752°–932° F.).

The term of the treatment during which the irradiated alloy is maintained within the prescribed temperature conditions to introduce resistance to irradiation induced stress corrosion cracking is dependent upon and varies proportionally with the level of the temperature employed in the treatment. Namely the length of the period over which the alloy is maintained at a temperature prescribed varies inversely proportionally with the temperature level of the heat treatment. For example with the temperature of 400° C. at the lower end of the preferred range, the period for maintaining the alloy at this level should be at least 24 hours whereas at 500° C., a temperature at the upper end of the preferred treatment range, the holding period is about one hour. For temperatures intermediate the prescribed boundaries of the preferred range, the period of such treatment would generally vary inversely proportionally with the temperature between about 24 hours at 400° to 1 hour at 500° C.

The restoration of intergranular stress corrosion cracking resistance according to this invention appears to be governed by an Arrhenius-type relationship, namely:

$$\log(\text{rate of restoration}) = C_1\left(\frac{1}{T(°K.)}\right) + C_2 \quad (1)$$

where $C_1$ and $C_2$ are constants, and T is the absolute temperature in degrees Kelvin. When two empirically derived data points, such as 400° C. for 24 hours and 500° C. for 1 hour, are used to define the time/temperature relationship, the above equation (1) becomes:

$$\log\left(\frac{1}{t(\text{hrs})} \times 10^2\right) = -7.187\left(\frac{10^3}{T(°K.)}\right) + 11.300 \quad (2)$$

This latter equation (2) can be used to obtain an effective heat treating time for any given temperature ranging from below 400° C. to above 500° C. For example, a temperature of about 350° C. would require a heat period of approximately 172 hours to effectively restore resistance to intergranular stress corrosion cracking in a highly irradiated austenitic alloy. Obviously, at some point of time and lower temperature, the heat treatment becomes too long to be practical.

Conversely, at the other extreme, the temperature cannot be continuously increased because, among other likely detriments such as distortion or shock, the thermal energy introduced into the alloy will reach a level of precipitating significant quantities of chromium carbides in the grain boundaries of the alloy. Such precipitation normally takes place at temperatures above about 500° C. and below about 800° C.

The heat treatment of this invention, and the subsequent cooling therefrom, does not require or employ any special conditions such as atmospheric control or prescribed rates for carrying out temperature changes. That is the heat treatment can be applied in normal ambient conditions, namely in air without vacuum or a controlled atmosphere of either imposed reducing or oxidizing conditions.

Moreover, cooling down from the prescribed heat treatment can be effectively achieved simply by terminating the source of heat energy and thereby enabling dissipation of the added thermal energy by normal ambient conditions, either within the confines or environment of a heating means such as a furnace, or removed therefrom; without added means for retarding or accelerating the energy reduction.

The significant influence of the heat treatment of this invention upon the susceptibility of irradiated austenitic stainless steel to intergranular stress corrosion cracking, and the effect of the parameters of the heating conditions are aptly demonstrated in the following comparative evaluations of the novel treatment of this invention in relation to similar applications of heat which fall outside the scope of this invention.

In the following examples, or comparative evaluations of exemplary tests of the practice of this invention in relation to similar but excluded conditions, a series of like samples of the same Type 304 stainless steel alloy were irradiated, heat treated and then tested and evaluated all as specified in Table I. Standards of the same alloy are also provided, that is a sample which was neither irradiated nor specially heat treated, and a sample which was irradiated but not specially heat treated, to provide a basis for illustrating the relative effects of the treatment of this invention both with the standards and other treatments outside of the scope of this invention.

TABLE I

| Sample Type 304 SS | Irradiation Fast (E > 1 MeV) Neutron Fluence | Heat Treatment Temp./Time | Post Heat Percent IGSCC* | Post Heat Treat. Knoop Hardness |
|---|---|---|---|---|
| A | Unirradiated mill-annealed | None | 0 | 191. |
| B | Irradiated [Fast (E > 1 MeV) neutron fluence: $2.83 \times 10^{21}$ n/cm$^2$] | None | 100 | 404. |
| C | Irradiated to $2.45 \times 10^{21}$ n/cm$^2$ | 400° C./24 hrs. | <10 | 381. |
| D | Irradiated to $2.45 \times 10^{21}$ n/cm$^2$ | 450° C./24 hrs. | 5 | 355. |
| E | Irradiated to $2.90 \times 10^{21}$ n/cm$^2$ | 500° C./1 hr. | 0 | — |
| F | Irradiated to $2.46 \times 10^{21}$ n/cm$^2$ | 500° C./24 hrs. | 100 | 255. |
| G | Irradiated to $2.80 \times 10^{21}$ n/cm$^2$ | 500° C./720 hrs. | 100 | 269. |
| H | Irradiated to $2.21 \times 10^{21}$ n/cm$^2$ | 550° C./24 hrs. | 80 | 226. |

*% IGSCC values estimated from Scanning Electron Microscope observations.

The data derived from the comparative tests and presented in Table I demonstrates the significant effects with respect to intergranular stress corrosion cracking provided by the specific conditions of thiS invention, and moreover also illustrates the parameters of the means for carrying out the invention.

The treatment of this invention is applicable to many austenitic stainless steel components of boiling water nuclear reactors such as control blades, top guides, and shrouds since the preferred temperatures for effecting the treatment are below those at which such stainless steel alloys sensitize through chromium carbide precipitation. Moreover, the temperature range is sufficiently low to minimize thermal distortion of precision components.

The heat treatment of the stainless steel alloys or articles of manufacture thereof comprising reactor components can be achieved by conventional means such as hot air, resistance heaters, quartz lamps, laser heaters and the like heat sources. Cooling thereafter can be at sufficiently slow rates, such as furnace or ambient air cooling, to eliminate excessive cooling stresses and related distortions.

What is claimed is:

1. A method of reducing stress corrosion cracking attributable in part to irradiation, in an austenitic type alloy, consisting essentially of heating an irradiated austenitic alloy selected from the group consisting of stainless steel and nickel-based alloy by heating to an approximate temperature range of about 400° to about 500° C. and holding the austenitic alloy at the temperature in said approximate temperature range over a period, varying inversely proportional with the temperature, comprising about 24 hours to about one hour, said heating and holding of the temperature for the alloy being under normal atmospheric ambient conditions.

2. A method of reducing stress corrosion cracking attributable in part to irradiation, in a stainless steel of the austenitic type, consisting essentially of treating an irradiated chromium-nickel austentic stainless steel by heating to a temperature range of about 350° to about 500° C. and holding the stainless steel at said temperature range for a period, varying inversely proportional with the tempeature, of about 172 hours to about one hour, said heating and holding of the temperature for the alloy being under normal atmospheric ambient conditions.

3. A method of reducing stress corrosion cracking, attributable at least in part to exposure to irradiation, in stainless steel of the austenitic type, consisting essentially of treating an irradiated chromium-nickel austenitic stainless steel by heating to an approximate temperature of about 400° to about 500° C. and holding the stainless steel at said approximate temperature range for a period, varying inversely proportional with the temperature, of about 24 hours to about one hour, said heating and holding of the temperature for the alloy being under normal atmospheric ambient conditions.

4. The method of claim 3, wherein the irradiated stainless steel of the austenitic type is heated to an approximate temperature of about 400° and held at said temperature for a period of about 24 hours.

5. A method of reducing stress corrosion cracking, attributable at least in part to exposure to irradiation, in stainless steel of the austenitic type, consisting essentially of treating an irradiated stainlees steel alloy comprising about 16 to about 20 percent weight of chromium and about 6 to about 15 percent weight of nickel by heating to a temperature range of about 400° to about 500° C. and holding the stainless steel at said temperature range for a period, varying inversely proportional with the temperature, of about 24 hours to about one hour, said heating and holding of the temperature for the alloy being under normal atmospheric ambient conditions.

6. The method of claim 5, wherein the irradiated stainless steel is heated to an approximate temperature of about 500° C. for a period of about one hour.

7. A method of reducing stress corrosion cracking, attributable at least in part to exposure to irradiation, in stainless steel of the austentic type, consisting essentially of treating an irradiated stainless steel alloy consisting essentially of about 16 to about 20 percent weight of chromium and about 6 to 15 percent weight of nickel with up to a maximum of about 2 percent weight of manganese and the balance iron with only incidental impurities, by heating to an approximate temperature range of about 400° to about 500° C. and holding the stainless steel at said tempeature range for a period, varying inversely proportional with the temperature, of about 24 hours to about one hour, said heating and holding of the temperature for the alloy being under normal atmospheric ambient conditions.

8. The method of claim 7, wherein the irradiated stainless steel is heated to an approximate temperature of about 500° C. for a period of about one hour.

9. The method of claim 7, wherein the irradiated stainless steel is heated to an approximate temperature of about 400° C. for a period of about 24 hours.

10. The method of reducing stress corrosion cracking, attributable at least in part to exposure to irradiation, in stainless steel of the austenitic type, consisting essentially of treating an irradiated stainless steel alloy consisting essentially of about 18 to about 20 percent weight of chromium and about 8 to 12 percent weight of nickel with up to a maximum of about 2 percent weight of manganese and the balance iron with only incidental impurities, by heating to an approximate temperature range of about 350° to about 500° C. and holding the stainless steel at the temperature in said approximate temperature range for a period, varying inversely proportional with the temperature, of about 172 hours to about one hour, said heating and holding of the temperature for the alloy being under normal atmospheric ambient conditions.

11. The method of claim 10, wherein the irradiated stainless steel is heated to a temperature of about 400° to about 500° C. for a period of about 24 hours to about one hour.

12. A method reducing stress corrosion cracking, attributable in part to irradiation, in a manufactured article of a stainless steel of the austenitic type, consisting essentially of treating an irradiated article of manufacture composed of chromium-nickel austenitic stainless steel by heating the article to an approximate temperature range of about 350° up to about 500° C. and holding the stainless steel article at the temperature in said apporoximate temperature range for a period, varying inversely proportional with the temperature, of about 172 hours to about one hour, said heating and holding of the temperature for the alloy being under normal atmospheric ambient conditions.

13. The method of claim 12, wherein the irradiated article of manufacture of stainless steel of the austenitic type is heated to a temperature of about 400° to about 500° C. and held at said temperature range for a period of a period of about 24 hours to about one hour.

14. A method of reducing stress corrosion cracking, attributable at least in part to irradiation, in a manufactured article of a stainless steel of the austenitic type, consisting essentially of treating an irradiated article of manufacture composed of a stainless steel alloy comprising about 16 to 20 percent weight of chromium and about 6 to about 15 percent weight of nickel by heating to an approximate temperature range of about 400° to about 500° C. and holding the stainless steel article at said temperature range for a period, varying inversely proportional with the temperature, of about 24 hours to about one hour, said heating and holding of the temperature for the alloy being under normal atmospheric ambient conditions.

15. The method of reducing stress corrosion cracking, attributable at least in part to exposure to irradiation, in a manufactured article of austenitic stainless steel, consisting essentially of treating an irradiated article of manufacture composed of a stainless steel alloy consisting essentially of about 18 to about 20 percent weight of chromium and about 8 to 12 percent weight of nickel with a maximum of up to about 2 percent weight of manganese and the balance iron with only incidental impurities, by heating to an approximate temperature range of about 350° to about 500° C. and holding said stainless steel article of manufacture at the temperature in said approximate temperature range for a period, varying inversely proportional with the temperature, of about 172 hours to about one hour, said heating and holding of the temperature for the alloy being under normal atmosperic ambient conditions.

16. The method of claim 15, wherein the irradiated stainless steel article of manufacture is heated to a temperature of about 400° to about 500° for a period of about 24 hours to about one hour.

17. A method of reducing stress corrosion cracking, attributable in part to irradiation, in an austenitic type nickel-based alloy, consisting essentially of treating an irradiated austenitic nickel-based alloy by heating to an approximate temperature range of about 350° to about 500° C. and holding the austenitic type nickel-based alloy at the temperature in said approximate temperature range for a period, varying inversely proportional with the temperature of about 172 hours to about one hour, said heating and holding of the temperature for the alloy being under normal atmospheric ambient conditions.

18. The method of claim 17, wherein the irradiated austenitic nickel-based alloy is heated to a temperature of about 400° to about 500° C. for a period of about 24 to about one hour.

19. A method of reducing stress corrosion cracking attributable in part to irradiation, in an article of manufacture of an austenitic type nickel-based alloy, consisting essentially of treating an irradiated article of manufacture composed of austenitic nickel-based alloy consisting of a major amount of nickel and minor amounts of chromium and iron, by heating to a temperature range of about 350° to about 500° C. and holding saids nickel-based alloy article of manufacture at said temperature range for a period, varying inversely proportional with the temperature, of about 172 hours to about one hour, said heating and holding of the temperature for the alloy being under normal atmospheric ambient conditions.

20. The method of claim 19, wherein the irradiated nickel-based alloy article of manufacture is heated to a temperature of about 400° to about 500° C. for a period of about 24 hours to about one hour.

* * * * *